US006662719B1

(12) United States Patent
Adachi

(10) Patent No.: US 6,662,719 B1
(45) Date of Patent: Dec. 16, 2003

(54) THERMOSENSITIVE STENCIL AND PLATE AND THERMAL STENCIL PLATE MAKING AND STENCIL PRINTING METHOD THEREFOR

(75) Inventor: Hiroshi Adachi, Numazli (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/227,753

(22) Filed: Jan. 8, 1999

(30) Foreign Application Priority Data

Jan. 9, 1998 (JP) ..... 10-015153
Jul. 2, 1998 (JP) ..... 10-187210
Dec. 18, 1998 (JP) ..... 10-361043

(51) Int. Cl.[7] ..... B05C 17/06
(52) U.S. Cl. ..... 101/128.21; 101/127
(58) Field of Search ..... 101/128.21, 128.4, 101/127; 428/311.11, 311.31

(56) References Cited

U.S. PATENT DOCUMENTS 3,715,267 A * 2/1973 Kubo et al. ..... 161/165
4,434,198 A * 2/1984 Clark ..... 428/43
5,617,787 A * 4/1997 Takita et al. ..... 101/129
6,447,895 B1 * 9/2002 Kamir et al. ..... 428/311.11

FOREIGN PATENT DOCUMENTS

| | | | |
|---|---|---|---|
| DE | 4444846 | * | 3/1996 |
| JP | 52-80130 | * | 7/1977 |
| JP | 54-63763 | * | 5/1979 |
| JP | 62-33689 | * | 2/1987 |
| JP | 06-64134 | * | 3/1994 |
| JP | 06-99678 | * | 4/1994 |
| WO | 98/43823 | * | 10/1998 |

* cited by examiner

*Primary Examiner*—Ren Yan
(74) *Attorney, Agent, or Firm*—Cooper & Dunham LLP

(57) ABSTRACT

A thermosensitive stencil sheet including at least a thermoplastic resin film and an electromagnetic wave absorbing layer which includes an electromagnetic wave absorbing agent and a resin. The thermosensitive stencil sheet may also include a porous substrate and/or a protective layer. A thermal stencil printing method in which the thermosensitive stencil sheet is imagewise perforated with an electromagnetic wave to prepare a stencil plate and then the resultant stencil plate is subjected to a printing operation to form images is also provided. A multi-color thermal stencil printing method using the thermosensitive stencil sheet is also provided.

14 Claims, 4 Drawing Sheets

THERMOSENSITIVE STENCIL AND PLATE AND THERMAL STENCIL PLATE MAKING AND STENCIL PRINTING METHOD THEREFOR

BACKGROUND OF THE INVENTION

1. Field of the Invintion

The present invention relates to a thermosensitive stencil sheet and a thermosensitive stencil plate, and to a thermal stencil plate making and stencil printing method therefor.

2. Discussion of the Related Art

Currently, thermal stencil plate making and stencil printing methods (hereinafter referred to as stencil printing methods) are well known in which a thermosensitive stencil sheet, which includes a thermoplastic resin film formed overlying an ink permeable substrate, is heated imagewise with a thermal printhead to form imagewise perforations in the resin film, i.e., to form a stencil plate, and then printing ink is allowed to pass through the perforations to form an image on a receiving material such as paper. However, the density of the perforations of these stencil printing methods, which depends on the density of the heating elements of the thermal printhead used for the imagewise heating, is 600 dpi (dots per inch) at the most under the present conditions, and therefore the resolution of the resultant print image is not good. In addition, the printing methods have another drawback in that the thermoplastic film tends to adhere to the thermal printhead and thereby desired perforations cannot be formed in the stencil sheet because of insufficient heat conduction of the heat elements, resulting in occurrence of omissions in the resultant print image. In attempting to improve these drawbacks, thermal stencil printing methods have been proposed in which an electromagnetic wave such as laser light. digitally irradiates a thermoplastic resin film of a stencil sheet to form imagewise perforations.

Japanese Laid-Open Patent Publication No. 61-229560 discloses a method for forming a stencil plate in which a laser beam which is modulated according to image patterns scans on a thermoplastic resin film of a thermosensitive stencil sheet in which the resin film is laminated with a porous thin paper, to form imagewise perforations in the stencil sheet. Japanese Laid-Open Patent Publication No. 6-127106 discloses a method for forming a stencil plate in which laser light irradiates the front side of a thermosensitive stencil sheet to form imagewise perforations therein utilizing heat which is generated with the laser light in a layer of ink, which is formed on the back side of the stencil sheet and which includes a heat generating material which generates heat by absorbing the laser light. By using these methods, the drawbacks of poor resolution and adhesion of the resin film to thermal printheads are mitigated or avoided.

However, the method disclosed in Japanese Laid-Open Patent Publication No. 61-229560 has a drawback in that the resin film itself has to absorb the laser light so as to be perforated and therefore the light source is particularly limited to high-powered laser light sources which can oscillate laser light having a long wavelength not less than 1 $\mu$m. Therefore, since a laser diode having a relatively low cost cannot be used for the stencil printing apparatus used for the method, the printing apparatus becomes large and manufacturing cost of the printing apparatus increases. In addition, the method disclosed in Japanese Laid-Open Patent Publication No. 6-127106 has a drawback in that the heat generated in the ink layer tends to diffuse to the layer of ink and therefore it takes relatively large energy to make perforations in a stencil sheet, resulting in decrease of the speed of making a stencil plate. Further, the method has a drawback in that the image qualities thereof deteriorate because the perforations tend to be blocked with the ink in which the vehicle therein is evaporated due to the heat generated, or in the case of an emulsion type ink, because an aqueous phase and an oil phase of the emulsion ink separate from each other due to the heat generated.

In attempting to overcome these drawbacks, thermosensitive stencil sheets have been disclosed which can absorb laser light emitted from a compact laser diode, and methods for making stencil plates using the stencil sheets have also been disclosed.

For example, Japanese Laid-Open Patent Publication No. 62-33689 discloses a thermosensitive stencil sheet in which a thermoplastic resin film including an agent capable of absorbing an electromagnetic wave is laminated with a porous material. Japanese Laid-Open Patent Publication No. 62-181149 discloses a method for preparing a stencil plate in which the stencil sheet is perforated with semiconductor laser light according. to image information. In addition, Japanese Laid-Open Patent Publication No.6-64134 discloses a method for preparing a stencil plate in which a thermosensitive stencil sheet including an agent capable of absorbing an electromagnetic wave is perforated with a laser beam wherein the ten-point mean roughness of the surface of the stencil sheet is smaller than the depth of focus of the laser beam.

However, the layers of these stencil sheets which include an electromagnetic wave absorbing agent tend to have relatively low mechanical strength. In stencil printing, a stencil plate is mechanically stressed by printing pressure when an ink is transferred to a receiving paper. Therefore, the electromagnetic wave absorbing layers having relatively low mechanical strength are easily broken. If the refuse of the layers adheres to the receiving paper, the refuse makes the resultant print images dirty. In addition, if the refuse adheres to the stencil plate, serious image defects such as background fouling (black spots) are produced. In particular, when the stencil printing is performed for a long time, the stencil plate is seriously damaged because of being subjected to the mechanical stress many times.

Although the durability of a stencil plate in continuous use is a very important property of the stencil plate, the durability of the stencil plate which is prepared by a stencil plate making method using an electromagnetic wave as a perforating medium has not been studied at all. Therefore there have been no proposals, by which the durability of the stencil plate is improved, in the case when the stencil plate is prepared using an electromagnetic wave.

Because of these reasons, a need exists for a thermosensitive stencil sheet which can produce a stencil plate by a method in which a stencil plate is prepared with a low-cost and compact stencil printing apparatus using an electromagnetic wave such as laser light and the resultant stencil plate can produce good images on a receiving material even when printing is performed for a long time.

SUMMARY OF THE INVENTION

Accordingly, an object of the present invention is to provide a thermosensitive stencil sheet which can produce a stencil plate by a method in which a stencil plate is prepared with a low-cost and compact stencil printing apparatus using an electromagnetic wave as a perforation forming medium and the resultant stencil plate can produce good images on a receiving material even when printing is performed for a long time.

Another object of the present invention is to provide a stencil printing method in which images or color images having good image qualities are formed on a receiving material using a low-cost and compact stencil printing apparatus using an electromagnetic wave as a perforation forming medium.

To achieve such objects, the present invention contemplates the provision of a thermosensitive stencil sheet including at least a thermoplastic resin film and an electromagnetic wave absorbing layer which includes an electromagnetic wave absorbing agent and a resin. The stencil sheet preferably includes a porous substrate which is laminated on the resin film, and in addition, a protective layer may be formed overlying the electromagnetic wave absorbing layer.

In another aspect of the present invention, a stencil printing method is provided which includes the steps of:

providing a thermosensitive stencil sheet which includes a thermoplastic resin film and an electromagnetic wave absorbing layer including an electromagnetic absorbing agent and a resin, and optionally includes a porous substrate and/or a protective layer;

irradiating the thermosensitive stencil sheet with laser light to form a stencil plate in which imagewise perforations are formed in the stencil sheet; and applying an ink on one side of the stencil plate, the opposite side of which contacts a receiving material under pressure, to transfer an ink image onto the receiving material.

By repeating these steps using, for example, a yellow, a magenta, a cyan and a black ink, a full color image can be obtained.

The stencil plate is preferably wound on a peripheral surface of a drum such that the stencil plate contacts a receiving material, and is then inked by inking from the inside of the drum to form an image on the receiving material.

These and other objects, features and advantages of the present invention will become apparent upon consideration of the following description of the preferred embodiments of the present invention taken in conjunction with the accompanying drawings.

BRIEF DESCRIPTION OF THE DRAWING(S)

Figure 8:
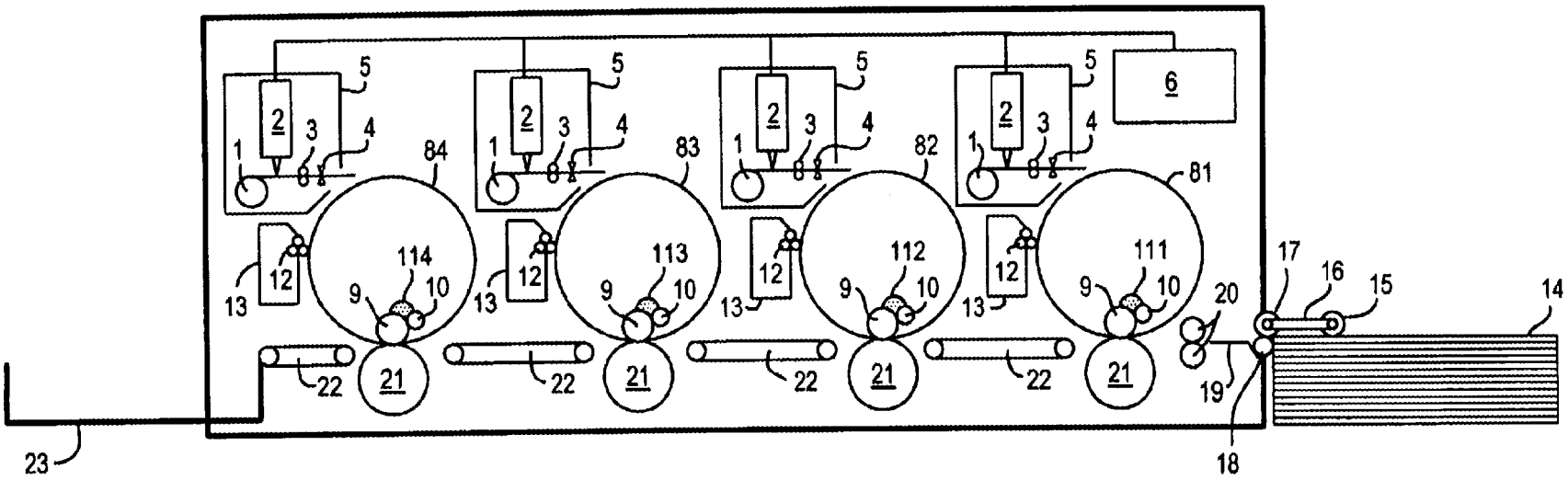
Figure 9:
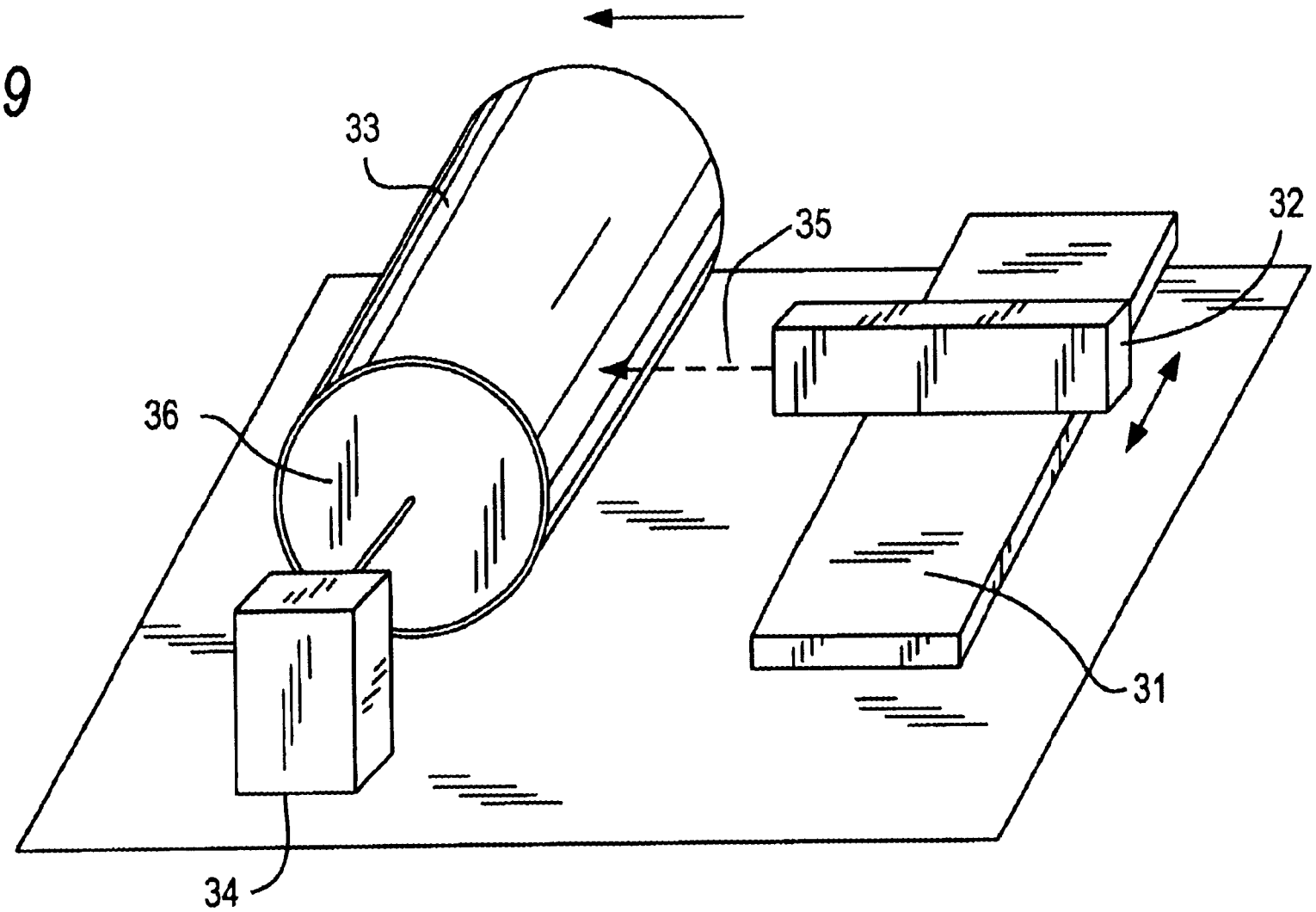

FIG. 8 is a schematic diagram illustrating a sectional view of a multi-color thermal stencil plate making and stencil printing apparatus useful for the thermal stencil printing method of the present invention; and FIG. 9 is a schematic diagram illustrating a stencil plate making apparatus which produces thermal stencil plates useful for the thermal stencil plate printing method of the present invention.

DESCRIPTION OF THE PREFERRED EMBODIMENTS

Figure 1:
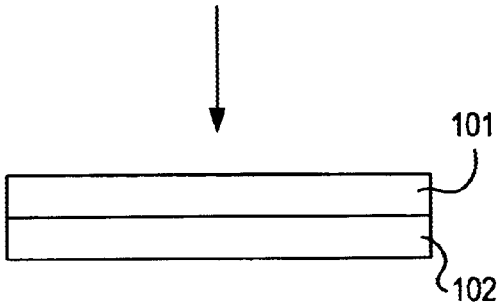
FIG. 1 is a schematic diagram illustrating a sectional view of an embodiment of the thermosensitive stencil sheet of the present invention.
Figure 4:
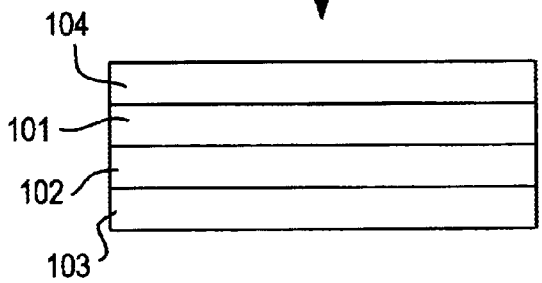
FIG. 4 is a schematic diagram illustrating a sectional view of still another embodiment of the thermosensitive stencil sheet of the present invention.
Figure 2:
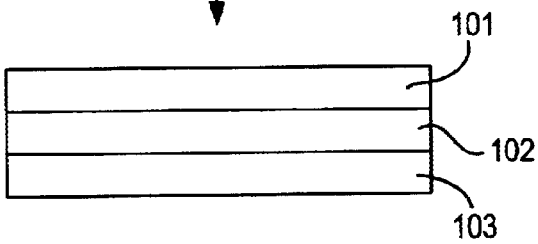
FIG. 2 is a schematic diagram illustrating a sectional view of another embodiment of the thermosensitive stencil sheet of the present invention.
Figure 5:
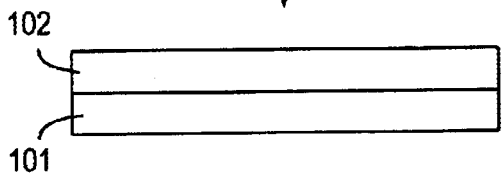
FIG. 5 is a schematic diagram illustrating a sectional view of a further embodiment of the thermosensitive stencil sheet of the present invention.
Figure 3:
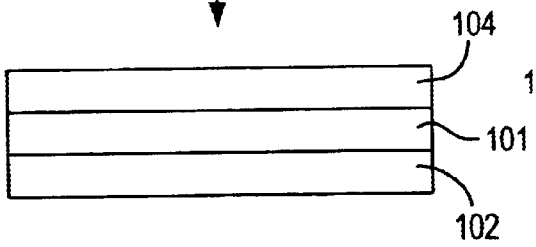
FIG. 3 is a schematic diagram illustrating a sectional view of yet another embodiment of the thermosensitive stencil sheet of the present invention.
Figure 6:
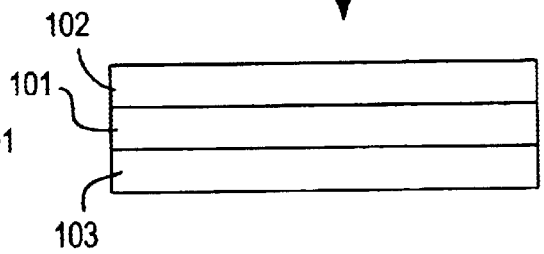
FIG. 6 is a schematic diagram illustrating a sectional view of a still further embodiment of the thermosensitive stencil sheet the present invention.

FIGS. 1 and 5 are schematic diagrams illustrating sectional views of embodiments of the thermosensitive stencil sheet of the present invention which include at least an electromagnetic wave absorbing layer 101 and a thermoplastic resin film 102, wherein the electromagnetic wave absorbing layer 101 includes an electromagnetic wave absorbing agent and a resin. In these cases, an electromagnetic wave (represented by an arrow) may irradiate the printing sheet either from the side of the electromagnetic wave absorbing layer 101 (FIG. 1), or the side of the resin film 102 (FIG. 5). As shown in FIGS. 2 and 6, the thermosensitive stencil printing sheet may further include a porous substrate 103. In these cases, an electromagnetic wave preferably irradiates the printing sheet from the side of the electromagnetic wave absorbing layer 101 (FIG. 2), or the side of the resin film 102 (FIG. 6). In addition, as shown in FIGS. 3 and 4, the stencil sheet may include a protective layer 104 overlying the electromagnetic wave absorbing layer 101. In these cases, an electromagnetic wave preferably irradiates the printing sheet from the side of the protective layer 104. When the stencil'sheet has a structure which is as shown in FIGS. 1 or 5, the stencil sheet is preferably subjected to a printing operation such that the resin film 102 contacts a recording material, to prevent the electromagnetic wave absorbing layer 101 from being damaged by the mechanical stresses in stencil printing. The structure of the stencil sheet of the present invention is not limited to those as shown in FIGS. 1–6.

The content of the electromagnetic wave absorbing agent in the electromagnetic wave absorbing layer 101 is preferably from about 20 to about 80% by weight, and more preferably from about 30 to about 70% by weight, to maintain good mechanical strength of the electromagnetic wave absorbing layer 101, which results in formation of images having good image qualities. When an electromagnetic wave absorbing agent is excessively included in the electromagnetic wave absorbing layer 101, the electromagnetic wave absorbing layer 101 tends to be damaged by mechanical stresses in printing operations because the electromagnetic wave absorbing layer has poor mechanical strength and poor adhesion to the resin film. When the electromagnetic wave absorbing layer is damaged, refuse of the layer tends to be produced. When the refuse adheres to a receiving material or a stencil sheet, image qualities of the resultant images deteriorate. When a resin is not included in the electromagnetic wave absorbing layer, the mechanical strength of the layer seriously deteriorates, resulting in deterioration of durability of the stencil sheet. For the stencil sheets which are prepared by a stencil plate making method using an electromagnetic wave as a perforating medium, there have been no proposals in which an electromagnetic wave absorbing agent is used together with a resin. Therefore conventional stencil sheets have poor mechanical strength, and accordingly image qualities of the print images deteriorate particularly when images are printed for a long time.

On the contrary, when too little of an electromagnetic wave absorbing agent is included in the electromagnetic wave absorbing layer, the quantity of heat generated in the electromagnetic wave absorbing layer 101 is insufficient, resulting in formation of poor or no perforations in plate making, and thereby image qualities are poor. Both the resin film 102 and the electromagnetic wave absorbing layer 101 have to be melted by the heat generated in the layer 101 and therefore the electromagnetic wave absorbing agent is preferably included in the layer 101 in an amount of not less than about 20% by weight.

If the stencil sheet has only the electromagnetic wave absorbing layer 101 without the resin film 102, the layer 101 itself has too low mechanical strength to be subjected to a stencil printing operation, and therefore the stencil sheet breaks in printing.

Suitable electromagnetic wave absorbing agents for use in the electromagnetic wave absorbing layer 101 include any materials that absorb the electromagnetic wave, which irradiates the electromagnetic wave absorbing layer 101, to convert the absorbed electromagnetic wave energy to heat. Specific examples of such electromagnetic wave absorbing agents include carbon black, graphite, carbon nitride, silicon carbide, boron compounds, metal oxides, light absorbing metals, inorganic materials, organic dyes, organic pigments, and electromagnetic wave absorbing polymers. Among these electromagnetic wave absorbing agents, carbon black is preferable because carbon black is inexpensive and can be used for various electromagnetic waves.

Suitable resins for use in the electromagnetic wave absorbing layer 101 include polyvinyl butyral resins, polyethylene resins, polystyrene resins, polycarbonate resins, polyurethane resins, and the like. The resins are preferably thermoplastic in order to increase heat sensitivity in forming perforations therein. Among these resins, polyvinyl butyral resins are preferable because butyral resins have good adhesion to thermoplastic resin films and good perforation properties in that uniform perforations can be obtained.

It is currently preferred that the. electromagnetic wave absorbing layer 101 have a coating weight not greater than about 3.0 $g/m^2$ and that the resin film 102 have a thickness less than about 5.0 $\mu$m.

The thermosensitive stencil sheet of the present invention preferably includes a protective layer 104 to avoid deterioration of image qualities of the resultant printed images by preventing the electromagnetic wave absorbing layer 101 from being damaged by the mechanical stresses in stencil printing. Suitable materials for use in the protective layer 104 include any polymers. Specific examples of such polymers include polyethylene resins, polystyrene resins, polycarbonate resins, polyurethane resins and the like.

Suitable resin films for use as the resin film 102 include any thermoplastic resin films which are formed, for example, by extrusion methods, casting methods or the like and which can easily melt with the heat generated in the electromagnetic wave absorbing layer 101 by irradiation with an electromagnetic wave and can withstand the mechanical stresses in stencil printing. The thickness of the resin film 102 is preferably less than about 10 $\mu$m, and more preferably less than about 5 $\mu$m.

When the stencil sheet has a structure as shown in FIG. 5 or 6, a stencil plate which has imagewise perforations is preferably subjected to a printing operation such that the resin film 102 contacts a receiving material in order to obtain good images. This is because the electromagnetic wave absorbing layer can thereby be prevented from being damaged by the mechanical stresses in the printing operation.

Specific examples of such resin films include polyester resins (preferably polyester copolymers), nylon resins (preferably nylon copolymers), polyolefin resins, polystyrene resins, polyvinyl chloride resins, (meth)acrylic resins, ethylene-vinyl alcohol copolymers, polycarbonate resins (preferably polycarbonate copolymers) and the like. In addition, polymers which include an electromagnetic wave absorbing group therein are preferably used. Further, polymers having crystallinity not greater than about 15% are preferable, and amorphous polymers are more preferable because of having good perforation sensitivity.

Suitable materials for use as the porous substrate 103 include fibrous porous materials and porous resin films. Fibrous porous materials include natural fibers, chemical fibers, metal fibers and the like. These materials may be materials such as a textile sheet, a non-woven fabric sheet, or a paper sheet. These materials can be provided, for example, by laminating two or more materials.

Specific examples of the natural fibers include Manila hemp, flax, pulp, paper bush, paper mulberry, Japanese paper, cotton, kapok, ramie, coconut fiber, asbestos, wool, mohair, silk, and the like. Specific examples of the chemical fibers include fibers of polyamides such as nylon 6, nylon 66, aromatic nylons, and aramid, polyvinyl alcohols such as vinylon, polyvinylidene chlorides, polyvinyl chlorides, polyesters, polyacrylonitriles, polyacrylates, polyethylenes, polypropylenes, polyfluoroethylenes, and the like. The surface of such chemical fibers may be treated with a metal such as chromium. Specific examples of the metal fibers include fibers of stainless steel, iron, aluminum, and the like. In addition, other fibers such as carbon fibers and glass fibers can be used. These fibers can be employed alone or in combination.

Suitable materials for use as the porous resin films include resin films having a plurality of holes which are formed so as to bore through the resin films. Specific examples of such porous resin films include resin films such as those disclosed in Japanese Laid-Open Patent Publication No. 10-24667.

Next, stencil plate making and stencil printing apparatus (hereinafter referred to as stencil printing apparatus) useful for the stencil printing method of the present invention will be described with reference to FIGS. 7, 8 and 9.

Figure 7:
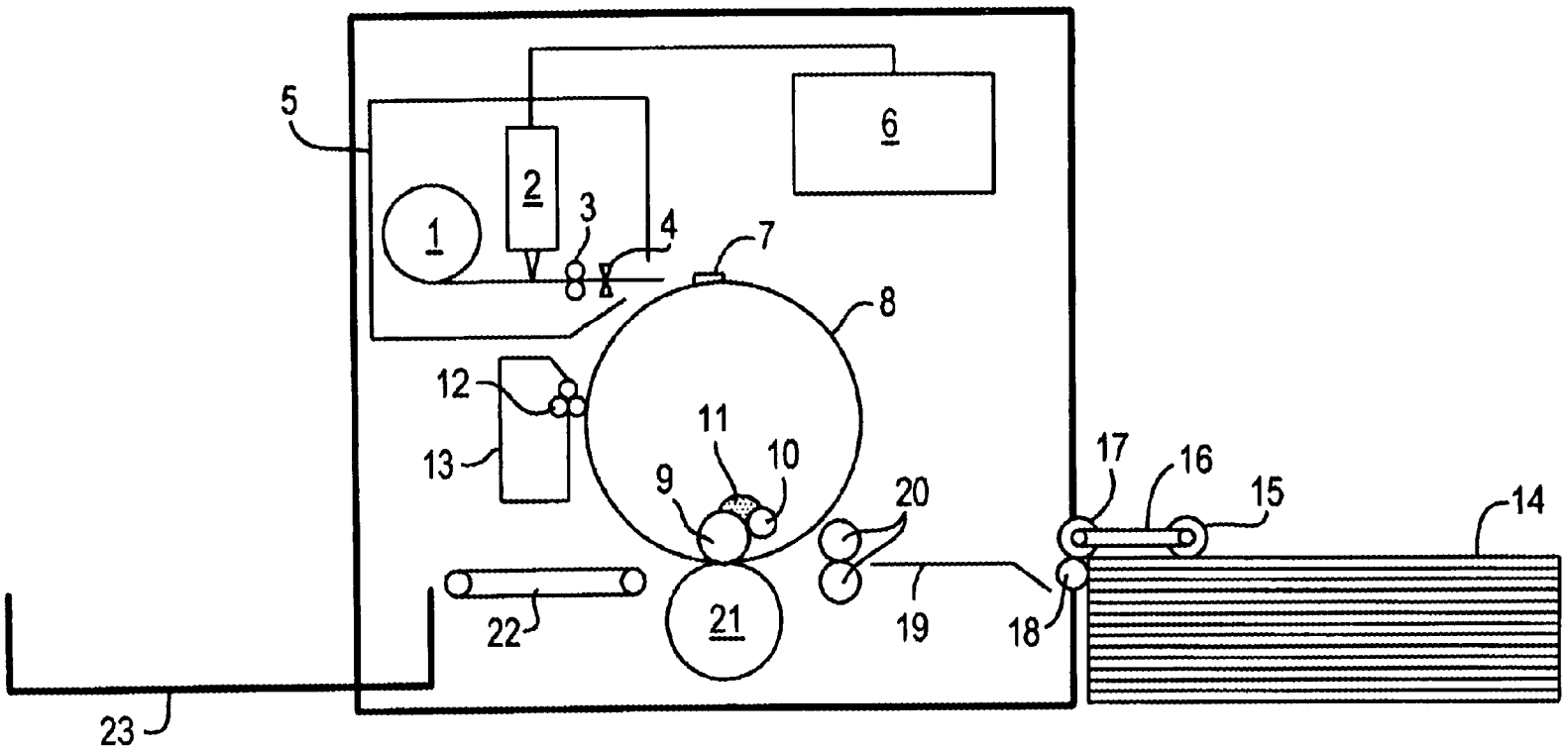
FIG. 7 is a schematic diagram illustrating a sectional view of a thermal stencil plate making and stencil printing apparatus useful for the thermal stencil printing method of the present invention.

FIG. 7 is a schematic diagram illustrating a sectional view of an stencil printing apparatus useful for the stencil printing method of the present invention. In a stencil plate making section 5, laser light which is emitted from a laser diode 2 and which is controlled by a controller 6 imagewise irradiates a thermosensitive stencil sheet 1 to form imagewise perforations in the thermosensitive stencil sheet 1. The stencil sheet 1 having imagewise perforations is fed by a pair of feeding rollers 3 and then cut with a cutter 4. The cut stencil sheet 1, i.e., a stencil plate, is clamped with a clamp 7 and then wound around the peripheral surface of a plate drum 8. The stencil sheet 1 (stencil plate) is inked with an ink 11 applied with an ink roller 9 on which a thin layer of the ink 11 is formed with a doctor roller 10. A sheet of receiving material 14 is fed by a roller 15 and separated from other receiving sheets (under the receiving sheet being fed) by separating rollers 17 and 18. The roller 15 and the separating roller 17 are synchronously rotated with a belt 16. The receiving material 14 is then fed on a guide plate 19, registered with a pair of registration rollers 20 and then fed to the nip of a press roller 21 and the plate drum 8 to receive ink images thereon. The receiving material 14 on which images are formed is then fed by a feeding belt 22 and discharged to a tray 23. In order to produce a plurality of images, the printing operation is repeated using the same stencil plate. After desired print images are obtained, the stencil sheet 1 is discharged into a box 13 by rollers 12.

FIG. 8 is a schematic diagram illustrating a sectional view of an embodiment of a color stencil printing apparatus useful for the stencil printing method of the present invention. The same numerals denote the same elements as mentioned above. Multi-color images can be obtained by performing the above-mentioned operations in four sections using four color inks 111–114 such as a yellow, a magenta, a cyan and a black ink, which are contained in plate drums 81–84, respectively.

FIG. 9 is a schematic diagram illustrating a stencil plate making apparatus which produces thermal stencil plates useful for a thermal stencil printing method of the present invention. In FIG. 9, an electromagnetic wave emitting source 32 imagewise scans a thermosensitive stencil sheet 33, which is wound on a drum 36, with an electromagnetic wave 35 while being fed on a feeding stand 31. The drum 36 is rotated with a motor 34. Thus imagewise perforations can be formed in the stencil sheet 33.

Suitable laser diodes for use in the stencil printing apparatus useful for the stencil printing method of the present invention include any laser diodes which can oscillate laser light having a wavelength of from an ultraviolet region to an infrared region. Theses laser diodes may be used alone or in combination, and may be used in combination with a non-linear optics material.

The stencil printing apparatus useful for the present invention is not limited to the apparatus mentioned above. For example, in FIGS. 7 and 8, the stencil sheet 1 is perforated before the stencil sheet 1 is wound on the peripheral surface of the plate drum 8 (drums 81–84 in FIG. 8); however, the stencil sheet 1 may be perforated after the sheet 1 is wound around the peripheral surface of the drum 8 (drum 81–84 in FIG. 8). In FIG. 8, the apparatus includes the four drums 81–84; however, the drums 81–84 can be replaced with a drum in which a plurality of ink chambers are formed can also be used.

When the apparatus as shown in FIG. 8 is used, an ink image transferred on the receiving material 14 at the first inking section tends to transfer to the plate drum 82 of the second inking section. The transferred ink on the drum 82 of the second inking section tends to transfer to the receiving material 14, resulting in occurrence of a ghost image. In order to solve this problem, an ultraviolet crosslinking ink which can be crosslinked with ultraviolet light, or an ink which changes its viscosity depending on temperature or shearing stress, can be preferably used.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

(Example 1 of Manufacturing Stencil Sheet of the Present Invention)

The following components were placed in a glass ball mill pot, in which 900 g of balls were contained, and then the ball mill pot was rotated on a ball mill stand for 24 hours to pulverize the carbon black and to obtain a carbon black dispersion.

| | |
|---|---|
| Carbon black | 1.30 g |
| Butyral resin | 11.70 g |
| Denatured ethanol | 117.0 g |

The thus obtained dispersion was coated on one side of a thermoplastic resin film 1.5 $\mu$m thick, which included polyethylene terephthalate as a main component and which was biaxially extended, with a wire bar of 0.05 mm in which a wire of 0.05 mm in diameter was wound on the peripheral surface of a rod, and then dried at 40° C. for 10 minutes to form an electromagnetic wave absorbing layer on the resin film and to prepare a stencil sheet. The coating weight of the electromagnetic wave absorbing layer was 1.10 g/m$^2$.

Thus, a two-layer type stencil sheet was prepared.

Example 2

(Example 2 of Manufacturing Stencil Sheet of the Present Invention)

The procedure for preparation of the stencil sheet in Example 1 was repeated except that the addition amounts of the carbon black and the butyral resin were changed to 2.60 g and 10.40 g and the coating weight of the electromagnetic wave absorbing layer was 1.15 g/m$^2$.

Example 3

(Example 3 of Manufacturing Stencil Sheet of the Present Invention)

The procedure for preparation of the stencil sheet in Example 1 was repeated except that the addition amounts of the carbon black and the butyral resin were changed to 5.20 g and 7.80 g and the coating weight of the electromagnetic wave absorbing layer was 1.08 g/m$^2$.

Example 4

(Example 4 of Manufacturing Stencil Sheet of the Present Invention)

The procedure for preparation of the stencil sheet in Example 1 was repeated except that the addition amounts of the carbon black and the butyral resin were changed to 7.80 g and 5.20 g and the coating weight of the electromagnetic wave absorbing layer was 1.18 g/m$^2$.

Example 5

(Example 5 of Manufacturing Stencil Sheet of the Present Invention)

The procedure for preparation of the stencil sheet in Example 1 was repeated except that the addition amounts of the carbon black and the butyral resin were changed to 9.10 g and 3.90 g and the coating weight of the electromagnetic wave absorbing layer was 1.25 g/m$^2$.

Example 6

(Example 6 of Manufacturing Stencil Sheet of the Present Invention)

The procedure for preparation of the stencil sheet in Example 1 was repeated except that the addition amounts of the carbon black and the butyral resin were changed to 10.40 g and 2.60 g and the coating weight of the electromagnetic wave absorbing layer was 1.16 g/m$^2$.

Example 7

(Example 7 of Manufacturing Stencil Sheet of the Present Invention)

The procedure for preparation of the stencil sheet in Example 1 was repeated except that the addition amounts of the carbon black and the butyral resin were changed to 11.70 g and 1.30 g and the coating weight of the electromagnetic wave absorbing layer was 1.15 g/m$^2$.

Example 8

(Example 8 of Manufacturing Stencil Sheet of the Present Invention)

The following components were placed in a glass ball mill pot, in which 900 g of balls were contained, and then the ball mill pot was rotated on a ball mill stand for 24 hours to pulverize the carbon black and to obtain a carbon black dispersion.

| | |
|---|---|
| Carbon black | 7.80 g |
| Butyral resin | 5.20 g |
| Denatured ethanol | 117.0 g |

A sheet was prepared in which a resin film 1.5 $\mu$m thick, which included polyethylene terephthalate as a main component and which was biaxially extended, was laminated with a Japanese paper.

The dispersion previously prepared was coated on the film side of the sheet with a wire bar of 0.05 mm, and then dried at 40° C. for 10 minutes to form an electromagnetic wave absorbing layer on the resin film and to prepare a stencil sheet. The coating weight of the electromagnetic wave absorbing layer was 1.20 g/m$^2$.

Thus, a three-layer type stencil sheet was prepared.

Example 9

(Example 9 of Manufacturing Stencil Sheet of the Present Invention)

The following components were placed in a glass ball mill pot, in which 900 g of balls were contained, and then the ball mill pot was rotated on a ball mill stand for 24 hours to pulverize the carbon black and to obtain a carbon black dispersion.

| | |
|---|---|
| Carbon black | 7.80 g |
| Butyral resin | 5.20 g |
| Denatured ethanol | 117.0 g |

The dispersion thus prepared was coated on one side of a resin film 1.5 $\mu$m thick, which included polyethylene terephthalate as a main component and which was biaxially extended, with a wire bar of 0.05 mm, and then dried at 40° C. for 10 minutes to form an electromagnetic wave absorbing layer on the resin film. The coating weight of the electromagnetic wave absorbing layer was 1.22 g/m$^2$. The thus prepared resin film having an electromagnetic wave absorbing layer was then laminated with a Japanese paper such that the Japanese paper contacted the surface of the electromagnetic wave absorbing layer, and dried at 40° C. for 10 minutes to prepare a stencil sheet.

Thus, a three-layer type stencil sheet was prepared.

Example 10

(Example 10 of Manufacturing Stencil Sheet of the Present Invention)

The following components were placed in a glass ball mill pot, in which 900 g of balls were contained, and then the ball mill pot was rotated on a ball mill stand for 24 hours to pulverize the carbon black and to obtain a carbon black dispersion.

| | |
|---|---|
| Carbon black | 10.40 g |
| Butyral resin | 2.60 g |
| Denatured ethanol | 117.0 g |

The dispersion thus prepared was coated on one side of a resin film 1.5 $\mu$m thick, which included polyethylene terephthalate as a main component and which was biaxially extended, with a wire bar of 0.05 mm, and then dried at 40° C. for 10 minutes to form an electromagnetic wave absorbing layer on the resin film. The coating weight of the electromagnetic wave absorbing layer was 1.15 g/m$^2$.

The following components were mixed and dissolved to prepare a polystyrene resin solution.

| | |
|---|---|
| Polystyrene (Denka Styrol HRM, manufactured by Denki Kagaku Kogyo K.K.) | 2.0 g |
| Toluene | 98.2 g |

The polystyrene resin solution was coated on the electromagnetic wave absorbing layer with a wire bar, and then dried at 40° C. for 10 minutes to form a protective layer. The coating weight of the protective layer was 0.25 g/m$^2$.

Thus a stencil sheet having a protective layer was prepared.

Example 11

(Example 11 of Manufacturing Stencil Sheet of the Present Invention)

The procedure for preparation of the stencil sheet in Example 4 was repeated except that the wire bar was changed to a wire bar of 0.20 mm, in which a wire of 0.20 mm in diameter was wound on the peripheral surface of a rod, to change the coating weight of the electromagnetic wave absorbing layer. The coating weight of the electromagnetic wave absorbing layer was 2.51 g/m$^2$.

Example 12

(Example of 12 Manufacturing Stencil Sheet of the Present Invention)

The procedure for preparation of the stencil sheet in Example 4 was repeated except that the wire bar was changed to a wire bar of 0.30 mm, in which a wire of 0.30 mm in diameter was wound on the peripheral surface of a rod, to change the coating weight of the electromagnetic wave absorbing layer. The coating weight of the electromagnetic wave absorbing layer was 3.35 g/m$^2$.

Example 13

(Example 13 of Manufacturing Stencil Sheet of the Present Invention)

The procedure for preparation of the stencil sheet in Example 4 was repeated except that the resin film was replaced with a thermoplastic resin film 3.5 $\mu$m thick which included polyethylene terephthalate as a main component and which was biaxially extended. The coating weight of the electromagnetic wave absorbing layer was 1.15 g/m$^2$.

Example 14

(Example 14 of Manufacturing Stencil Sheet of the Present Invention)

The procedure for preparation of the stencil sheet in Example 4 was repeated except that the resin film was replaced with a thermoplastic resin film 5.0 $\mu$m thick which included polyethylene terephthalate as a main component and which was biaxially extended. The coating weight of the electromagnetic wave absorbing layer was 1.18 g/m$^2$.

Example 15

(Example 15 of Manufacturing Stencil Sheet of the Present Invention)

The procedure for preparation of the stencil sheet in Example 4 was repeated except that the resin film was replaced with a thermoplastic resin film 0.8 $\mu$m thick which included polyethylene terephthalate as a main component and which was biaxially extended. The coating weight of the electromagnetic wave absorbing layer was 1.10 g/m$^2$.

Example 16

(Example 16 of Manufacturing Stencil Sheet of the Present Invention)

The procedure for preparation of the stencil sheet in Example 9 was repeated except that the Japanese paper was replaced with a nylon gauze (300 mesh). The coating weight of the electromagnetic wave absorbing layer was 1.15 g/m$^2$.

Example 17

(Example 17 of Manufacturing Stencil Sheet of the Present Invention)

The procedure for preparation of the stencil sheet in Example 9 was repeated except that the Japanese paper was replaced with a non-woven fabric including extrafine nylon fibers. The coating weight of the electromagnetic wave absorbing layer was 1.20 g/m$^2$.

Example 18

(Example 18 of Manufacturing Stencil Sheet of the Present Invention)

The procedure for preparation of the stencil sheet in Example 9 was repeated except that the Japanese paper was replaced with a stainless steel net (300 mesh). The coating weight of the electromagnetic wave absorbing layer was 1.10 g/m$^2$.

Example 19

(Example 19 of Manufacturing Stencil Sheet of the Present Invention)

The following butyral resin, ethyl, alcohol and water were mixed to prepare a butyral resin solution, and magnesium silicate was added to the resin solution and then dispersed in a ball mill to prepare a dispersion. The dispersion was filtered to prepare a porous resin film layer coating liquid.

| | |
|---|---|
| Polyvinyl butyral resin | 4.0 parts by weight |
| Ethyl alcohol | 35.5 parts by weight |
| Water | 11.5 parts by weight |
| needle magnesium silicate | 0.8 parts by weight |

(Aide Plus SP, manufactured by Mizusawa Chemical Industries Inc.)

The porous resin film layer coating liquid was coated on one side of a thermoplastic resin film, which included polyethylene terephthalate as a main component and which was biaxially extended, and then dried by hot air at 50° C. for 3 minutes to form a porous resin film layer. The coating weight of the porous resin film layer was 8.2 g/m$^2$.

The following components were placed in a glass ball mill pot, in which 900 g of balls were contained, and then the ball mill pot was rotated on a ball mill stand for 24 hours to pulverize the carbon black and to obtain a carbon black dispersion.

| | |
|---|---|
| Carbon black | 7.80 g |
| Butyral resin | 5.20 g |
| Denatured ethanol | 117.0 g |

The thus obtained carbon black dispersion was coated on the side of the resin film, which was opposite to the side on which the porous resin film layer was formed, with a wire bar of 0.05 mm, and then dried at 40° C. for 10 minutes to form an electromagnetic wave absorbing layer and to prepare a stencil sheet. The coating weight of the electromagnetic wave absorbing layer was 1.01 g/m$^2$.

Comparative Example 1

(Comparative Example 1 of Manufacturing Comparative Stencil Sheet)

The following components were placed in a glass ball mill pot, in which 900 g of balls were contained, and then the ball mill pot was rotated on a ball mill stand for 24 hours to pulverize the carbon black and to obtain a carbon black dispersion.

| | |
|---|---|
| Carbon black | 13.0 g |
| Denatured ethanol | 117.0 g |

The thus obtained dispersion was coated on one side of a resin film 1.5 $\mu$m thick, which included polyethylene terephthalate as a main component and which was biaxially extended, with a wire bar of 0.05 mm, and then dried at 40° C. for 10 minutes to form an electromagnetic wave absorbing layer of the resin film and to prepare a stencil sheet. The coating weight of the electromagnetic wave absorbing layer was 1.01 g/m$^2$.

The stencil sheets of the present invention in Examples 1–19 and the comparative stencil sheet in Comparative Example 1 were imagewise perforated with a stencil printing apparatus as shown in FIG. 9. The perforating conditions were as follows:

| | |
|---|---|
| Laser Diode: | |
| Maximum power in continuous oscillation: | 100 mW |
| Wavelength of laser light oscillated: | 827 nm |
| Irradiation conditions of laser light: | |
| Pulse width: | 300 $\mu$sec |
| Scanning speed in scanning direction: | 67 mm/sec |
| Feeding speed in feeding direction: | 14.2 $\mu$m/sec |
| Power of laser: | 40 mW |

Image to be reproduced: N-5 image of SCID (Standard Color Image Data published by Japanese Standard Association)

Example 20

(Example of Making Stencil Plate and Printing Images Using the Previously Prepared Stencil Sheet)

The stencil sheet prepared in Example 2 was imagewise perforated with the stencil printing apparatus as shown in FIG. 9 to prepare a stencil plate. When the stencil plate was observed with a microscope, perforations having an uniform size were formed therein without fail. The stencil plate was then wound on the peripheral surface of a Priport Color drum VT-A3IIVT-3820 (manufactured by Ricoh Co., Ltd.)

including a Priport Ink VT-1000 (manufactured by Ricoh Co., Ltd.) therein and then the drum was set in a stencil printing apparatus, Priport VT-3820 (manufactured by Ricoh Co., Ltd.).

When one thousand images were printed using a receiving material, PPC Paper type 6200 (manufactured by Ricoh Co., Ltd.), images having good image qualities without image defects such as background fouling were obtained. When the stencil plate was observed with a microscope after the printing, no peeling was observed in the electromagnetic wave absorbing layer.

Example 21

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 3.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 22

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 4.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 23

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 5.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 24

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 8.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 25

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 9.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 26

(Example of making stencil plate and printing images using the previously prepared stencil sheet) The procedures for preparation of the stencil plate and formation of one thousand print images. in Example 20 were repeated except that the stencil sheet was replaced with the stencil sheet prepared in Example 10.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 27

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 1.

When the stencil plate was observed with a microscope, perforations having an uniform size were formed therein without fail. The print images were slightly inferior in clearness to those obtained in Example 20. When the stencil plate was observed with a microscope after the printing, no peeling was observed in the electromagnetic wave absorbing layer.

Example 28

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 6.

When the stencil plate was observed with a microscope, perforations having an uniform size were formed therein without fail. The print images had slight background fouling. When the stencil plate was observed with a microscope after the printing, a little peeling was observed in the electromagnetic wave absorbing layer.

Example 29

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 7.

When the stencil plate was observed with a microscope, perforations having an uniform size were formed therein without fail. The print images had background fouling. When the stencil plate was observed with a microscope after the printing, peeling was observed in the electromagnetic wave absorbing layer.

Example 30

(Example of Making Stencil Plate and Printing Images Using the Previously Prepared Stencil Sheet)

The stencil sheet prepared in Example 4 was perforated with a stencil plate making apparatus as shown in FIG. 7. The thus obtained stencil plate was wound on the drum 8 of the apparatus, in which a black ink was contained, and then one thousand images were printed using a receiving material, PPC Paper type 6200 (manufactured by Ricoh Co., Ltd.).

The resultant print images had good image qualities without image defects such as background fouling. When the stencil plate was observed with a microscope after the printing, no peeling was observed in the electromagnetic wave absorbing layer.

Example 31

(Example of Making Stencil Plate and Printing Images Using the Previously Prepared Stencil Sheet)

Four sheets of the stencil sheet prepared in Example 4 were perforated with a stencil plate making apparatus as shown in FIG. 8 to prepare four stencil plates respectively having imagewise perforations corresponding to yellow, magenta, cyan and black image information of an original image. The four stencil plates thus prepared were respectively wound on drums 81, 82, 83 and 84 which respectively contained yellow, magenta, cyan and black ink, and then one thousand color images were printed using a receiving material, PPC Paper type 6200 (manufactured by Ricoh Co., Ltd.).

The resultant color images had good image qualities without image defects such as background fouling. When the stencil plates were observed with a microscope after the printing, no peeling was observed in the electromagnetic wave absorbing layers of the four stencil plates.

Example 32

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 11.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 33

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 13.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 34

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 15.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 35

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 16.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 36

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 17.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 37

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 18.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Example 38

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 19.

When the stencil plate was observed with a microscope, perforations having an uniform size were formed therein without fail. The print images had good image qualities without image defects such as background fouling. When the stencil plate was observed with a microscope after the printing, no peeling was observed in the electromagnetic wave absorbing layer.

Comparative Example 2

(Example of Making Stencil Plate and Printing Images Using the Previously Prepared Comparative Stencil Sheet)

The procedures for preparation of the stencil plate in Example 20 were repeated except that the stencil sheet was replaced with the comparative stencil sheet prepared in Comparative Example 1.

When only one image was printed in the same way as performed in Example 20, the image had serious background fouling. When the stencil plate was observed with a microscope after the printing, the electromagnetic wave absorbing layer was seriously peeled.

Example 39

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 12.

When the stencil plate was observed with a microscope, there were some omissions in the perforations formed corresponding to the image. The print images had slightly low image density but did not have background fouling. When the stencil plate was observed with a microscope after the printing, no peeling was observed in the electromagnetic wave absorbing layer.

Example 40

(Example of Making Stencil Plate and Printing Images Using the Previously Prepared Stencil Sheet)

The procedures for preparation of the stencil plate and formation of one thousand print images in Example 20 were repeated except that the stencil sheet was replaced with the stencil sheet prepared in Example 14.

When the stencil plate was observed with a microscope, there were some omissions in the perforations formed corresponding to the image. The print images had slightly low image density but did not have background fouling. When the stencil plate was observed with a microscope after the printing, no peeling was observed in the electromagnetic wave absorbing layer.

As can be understood from the above description, the thermosensitive stencil sheet of the present invention can produce good images even when printing is performed for a long time. In addition, according to the thermal stencil printing method of the invention, stencil plates having uniform and clear imagewise perforations can be obtained and therefore images having good image qualities such as good sharpness can be printed. Further, according to the thermal stencil printing method of the invention, full color images having good image qualities can be obtained.

Additional modifications and variations of the present invention are possible in light of the above teachings. It is therefore to be understood that within the scope of the appended claims the invention may be practiced other than as specifically described herein.

This document claims priority and contains subject matter related to Japanese Patent Applications Nos. 10-015153 and 10-187210, filed on Jan. 9, 1998, and Jul. 2, 1998, respectively, the entire contents of which are herein incorporated by reference.

What is claimed is:

1. A thermosensitive stencil sheet comprising at least a thermoplastic resin film and an electromagnetic wave absorbing layer which comprises an electromagnetic wave absorbing agent and a resin.

2. The thermosensitive stencil sheet according to claim 1, wherein the thermosensitive stencil sheet further comprises a porous substrate.

3. The thermosensitive stencil sheet according to claim 2, wherein the thermosensitive stencil sheet further comprises a protective layer which is formed overlying the electromagnetic wave absorbing layer, and is so disposed that an electromagnetic wave can irradiate the stencil sheet, to form imagewise perforations therein, in a direction such that the electromagnetic wave reaches the protective layer prior to the electromagnetic wave absorbing layer.

4. The thermosensitive stencil sheet according to claim 2, wherein the electromagnetic wave absorbing layer is formed overlying the resin film, and wherein the resin film is disposed between the electromagnetic wave absorbing layer and the porous substrate.

5. The thermosensitive stencil sheet according to claim 2, wherein the electromagnetic wave absorbing layer is formed overlying the resin film, and wherein the electromagnetic wave absorbing layer is disposed between the resin film and the porous substrate.

6. The thermosensitive stencil sheet according to claim 2, wherein the porous substrate comprises a porous material selected from the group consisting of porous materials including natural fibers, porous materials including chemical fibers, porous materials including metal fibers and porous resin films.

7. The thermosensitive stencil sheet according to claim 1, wherein the thermosensitive stencil sheet further comprises a protective layer which is formed overlying the electromagnetic wave absorbing layer, and is so disposed that an electromagnetic wave can irradiate the stencil sheet, to form imagewise perforations therein, in a direction such that the electromagnetic wave reaches the protective layer prior to the electromagnetic wave absorbing layer.

8. The thermosensitive stencil sheet according to claim 1, wherein the electromagnetic wave absorbing agent is present in the electromagnetic wave absorbing layer in an amount of from about 20 to about 80% by weight.

9. The thermosensitive stencil sheet according to claim 1, wherein the electromagnetic wave absorbing agent comprises carbon black.

10. The thermosensitive stencil sheet according to claim 1, wherein the electromagnetic wave absorbing layer has a coating weight not greater than about 3.0 $g/m^2$.

11. The thermosensitive stencil sheet according to claim 1, wherein the resin film has a thickness less than about 5.0 $\mu$m.

12. The thermosensitive stencil sheet according to claim 1, wherein the resin comprises a butyral resin.

13. A stencil plate in which imagewise perforations are formed using an electromagnetic wave, which is modulated according to image patterns, in a thermosensitive stencil sheet which comprises at least a thermoplastic resin film and an electromagnetic wave absorbing layer comprising an electromagnetic wave absorbing agent and a resin, and optionally also comprises a porous substrate.

14. The stencil plate according to claim 13, wherein the thermosensitive stencil sheet further comprises a protective layer which is formed overlying the electromagnetic wave absorbing layer, and wherein an electromagnetic wave irradiates the thermosensitive stencil sheet such that the electromagnetic wave reaches the protective layer prior to the electromagnetic wave absorbing layer.

* * * * *